US009764181B2

(12) United States Patent
Wagner et al.

(10) Patent No.: US 9,764,181 B2
(45) Date of Patent: Sep. 19, 2017

(54) QUICK EXCHANGE HANDLE

(71) Applicant: Exemplar Design, LLC, Mason, OH (US)

(72) Inventors: Leslie A. Wagner, Mukawonago, WI (US); Adam L. Ross, Mason, OH (US)

(73) Assignee: Exemplar Design, LLC, Mason, OH (US)

( * ) Notice: Subject to any disclaimer, the term of this patent is extended or adjusted under 35 U.S.C. 154(b) by 0 days.

(21) Appl. No.: 14/838,796

(22) Filed: Aug. 28, 2015

(65) Prior Publication Data

US 2015/0367165 A1 Dec. 24, 2015

Related U.S. Application Data

(63) Continuation of application No. 14/174,275, filed on Feb. 6, 2014, now Pat. No. 9,119,985.

(60) Provisional application No. 61/761,306, filed on Feb. 6, 2013.

(51) Int. Cl.

| | |
|---|---|
| ***A63B 21/00*** | (2006.01) |
| ***A63B 21/055*** | (2006.01) |
| ***A63B 23/12*** | (2006.01) |

(52) U.S. Cl.

CPC ..... *A63B 21/055* (2013.01); *A63B 21/00043* (2013.01); *A63B 21/0552* (2013.01); *A63B 21/0557* (2013.01); *A63B 21/4035* (2015.10); *A63B 23/12* (2013.01)

(58) Field of Classification Search

CPC ..... A63B 21/00

USPC ..... 482/49, 126

See application file for complete search history.

(56) References Cited

U.S. PATENT DOCUMENTS

| | | | | |
|---|---|---|---|---|
| 1,671,096 | A | 5/1928 | Anderson | |
| 4,520,525 | A | 6/1985 | Yogi et al. | |
| 5,505,691 | A | 4/1996 | Fenkell | |
| 5,660,550 | A | 8/1997 | Roche | |
| 5,681,243 | A * | 10/1997 | Criss | A63B 23/16 482/49 |
| 6,398,698 | B1 * | 6/2002 | Hinds | A63B 21/0004 482/124 |
| 6,497,641 | B1 * | 12/2002 | Hinds | A63B 21/00043 482/121 |
| 6,497,647 | B1 * | 12/2002 | Tucker | A61N 1/406 600/3 |
| 7,967,521 | B2 | 6/2011 | Schiavo | |

OTHER PUBLICATIONS

Image of resistance handles and cords—http://www.performbetter.com/wcsstore/MFACatalogAssetStore/images/catalog/7822PL.jpg—date retrieved Sep. 26, 2014.

(Continued)

*Primary Examiner* — Gregory Winter
(74) *Attorney, Agent, or Firm* — Baker & Hostetler LLP

(57) ABSTRACT

The resistance band system of the disclosure includes one or more resistance bands, and a pair of handles which secure the ends of the one or more resistance bands. Each handle locks onto one of the ends of each resistance band. The handle is adapted to grip the resistance band with greater force when force is applied to the resistance band, such as when it is in use. The handle unlocks to release the ends of one or more of the resistance bands from the handles for changing of one or more of the resistance bands.

20 Claims, 7 Drawing Sheets

(56) References Cited

OTHER PUBLICATIONS

Image of resistance handles and cords—http://i.walmartimages.com/i/p/00/69/43/94/90/0069439490041_500X500.jpg—date retrieved Sep. 26, 2014.
Image of resistance handles and cords—http://i.walmartimages.com/i/p/00/02/26/43/00/0002264300815_500X500.jpg—date retrieved Sep. 26, 2014.

* cited by examiner

QUICK EXCHANGE HANDLE

CROSS REFERENCE TO RELATED APPLICATIONS

This application is a continuation of and claims priority to U.S. application Ser. No. 14/174,275, filed on Feb. 6, 2014, which claims the benefit of Provisional Application No. 61/761,306, filed Feb. 6, 2013, both of which are hereby incorporated by reference.

BACKGROUND

The present disclosure generally pertains to exercise apparatus, and more particularly, to resistance bands used for fitness and exercise. Some examples of resistance bands according to the present disclosure may be used for fitness training to tone muscle and increase strength.

Resistance tubing comes in multiple elasticities to provide a selection of varying weights and sizes. Typically, a handle is permanently affixed on each end of a tubing, and each weight and size of resistance tube has its own set of handles.

Some handles allow for interchanging of fitness resistance tubing. Some handles include a cutout for resistance tubing and resistance tubing stretched to fit the tubing in place within the handle. Other handles include sliding mechanisms to slide one side of the handle up and down to place the tubing within the housing. However, these systems may not securely and safely hold resistance tubing in place, and may be time consuming and difficult to exchange tubing.

The apparatus, device, and system of the disclosure can be used in multiple fields, including fitness, exercise, and therapy. Other fields include, but are not limited to the medical, construction, and industrial fields.

SUMMARY

Exercise systems, resistance band systems and handles for resistance bands are generally disclosed. Some example embodiments may include methods, apparatus, and/or systems associated with resistance bands.

The resistance band system of the disclosure includes one or more resistance bands, and a pair of handles which secure the ends of the one or more resistance bands. Each handle locks onto one of the ends of each resistance band. The handle is adapted to grip the resistance band with greater force when force is applied to the resistance band, such as when it is in use. The handle unlocks to release the ends of one or more of the resistance bands from the handles for changing of one or more of the resistance bands.

In an embodiment, the apparatus of the disclosure includes two handles, and an accessory, such as a band, extending between the two handles. Each handle includes a housing and a pair of accessory capture blocks in the form of wedges that are nested within the housing. In a first position, the pair of wedges are fully nested within the housing, and positioned adjacently facing each other to form a funnel-shaped accessory channel therebetween. The funnel-shaped accessory channel has a larger diameter towards the grip end of the housing and a smaller diameter towards the accessory end of the housing. A grip extends from the grip end of the housing. When the wedges are in the first position, a conical protrusion or collar at an end of the accessory may be captured within the funnel-shaped accessory channel formed between the wedges.

In a second position, the pair of wedges are partially un-nested from the housing and separated from each other, creating a gap between the wedges so the conical collar at the end of the accessory may freely pass into and out of the housing between the wedges. The wedges may slide bi-directionally along the housing from the first position to the second position. A locking mechanism may secure the wedges in the first position to the housing. Examples of locking mechanisms include biased tangs, tabs, latches, bars, pins, spring loaded balls.

In some embodiments, a rigid collar is fastened tightly to each end of the accessory. The collar may be the portion of the accessory captured within the receiving funnel, and the rigidity of the collar prevents deformation and slipping from the funnel. The accessory may be a resistance band, resistance tube, resistance cable, cord, rod, or webbing.

In some embodiments, the pair of wedges jointly form a plurality of the funnel shaped opening therebetween for capturing a respective plurality of accessory end protrusions therein.

In some embodiments, the grip is attached to the housing with nylon webbing. In some embodiments, the grip is attached to the housing with rigid side rails. In some embodiments, the grip may rotate, and in other embodiments, the grip does not rotate.

In an embodiment an exercise system includes: (1) at least a pair of handles, where each handle includes (a) a housing having a grip end and an opposed accessory end, where the accessory end has an opening along an accessory axis, (b) a grip extending from the grip end, and (c) at least one accessory capturing block provided in the housing and slidable along an angled track within the housing between at least a first position approximate the accessory axis and a second position away from the accessory axis, where the first position provides a narrow width accessory opening and the second width providing a wider accessory opening; and (2) a linear accessory (which may be a resistance band, for example) having a pair of ends with a protrusion approximate each end sized to be captured within the accessory opening when the locking block is in its first position and sized to be passable through the accessory opening when the locking block is in its second position. In a more detailed embodiment, the exercise system includes a pair of the locking blocks slidable along opposed angled tracks within the housing towards and away from the accessory axis. In a further detailed embodiment, the locking blocks each include a semi-conical surface facing the accessory axis, such that the semi-conical surfaces form a funnel-shaped channel along the accessory axis when the locking blocks are in the first position. In a further detailed embodiment, the protrusions provided on the linear accessories are conical in shape corresponding to the funnel-shaped channel provided by the locking blocks in the first position. In a further detailed embodiment the accessory capturing blocks are releasably lockable to the first position. Alternatively or in addition, the tracks include a stop preventing the accessory capturing blocks from moving out beyond the second position. Alternatively or in addition, the accessory capturing blocks include a plurality of the conical shaped surface to provide a corresponding plurality of funnel-shaped accessory openings when the accessory capturing blocks are in the first position.

In an embodiment, an exercise system includes: (1) at least a pair of handles, where each handle includes: (a) a housing having a gripping end and an accessory end, where the accessory end having an opening with an accessory axis, (b) at least a pair of wedges provided in the housing and movable between a first and a second position within the housing, where in the first position the pair of wedges are nested within the housing adjacent to each other to jointly form a funnel-shaped channel along the accessory axis, where the funnel-shaped channel has a major diameter and approximate the gripping end of the housing and minor diameter at the accessory end of the housing when the pair of wedges are in the first position, and (c) a grip attached to the housing; and (2) an accessory having opposed ends, where each end has a conical collar respectively securable to one of the two handles and sized to be captured within the funnel-shaped channel when the pair of wedges are in the first position. In a more detailed embodiment, each of the pair of wedges comprise a semi-conical surface to form a respective portion of the funnel-shaped channel. Alternatively or in addition, in the second position the pair of wedges are partially un-nested from the housing and are separated by a gap sized to allow the conical collar of the accessory end to freely passes in the gap between the pair of wedges. Alternatively or in addition, the wedges slide along slanted tracks in the housing between the first position and the second position. Alternatively or in addition, the apparatus further includes a locking mechanism to releasably secure the wedges in the first position to the housing. Alternatively or in addition, the conical collars are formed from a rigid or a semi-rigid material. Alternatively or in addition, the pair of wedges jointly form a plurality of funnel-shaped channels for capturing a respective plurality of linear accessories therebetween. Alternatively or in addition the accessory is a resistance band, resistance tube, resistance cable, cord, rod, and/or webbing. Alternatively or in addition, the grip is attached to the housing with nylon webbing or the grip is attached to the housing with rigid side rails.

In an embodiment a method of using an exercise apparatus includes the steps of: (a) providing a handle comprising a gripping portion and an accessory holding portion, where the accessory holding portion includes a housing and at least one accessory capture block movable between a first position to provide an accessory opening in the housing of a first diameter to a second position to provide an accessory opening in the housing of a second diameter, larger than the first diameter; (b) providing one or more accessories, each end of each accessory having a collar with a diameter larger than the first diameter and smaller than the second diameter; (c) threading the collar of the accessory into the accessory opening when the accessory capture block is in the second position within the housing; and (d) capturing the collar within the accessory opening by moving the accessory capture block from the second position to the first position. In a further detailed embodiment, the method further includes the step of locking the accessory capture block in the first position. In an embodiment, the accessory holding portion includes at least a pair of the accessory capture blocks movable towards and away from each other between the first position the second position, and the capturing step involves moving each of the accessory capturing blocks from the second position to the first position. In an embodiment, the accessory capture block is movable along an angled track in the housing that is angled away from an accessory axis.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope. The disclosure will be described with additional specificity and detail through use of the accompanying drawings.

In the drawings.

DETAILED DESCRIPTION

Figure 1:
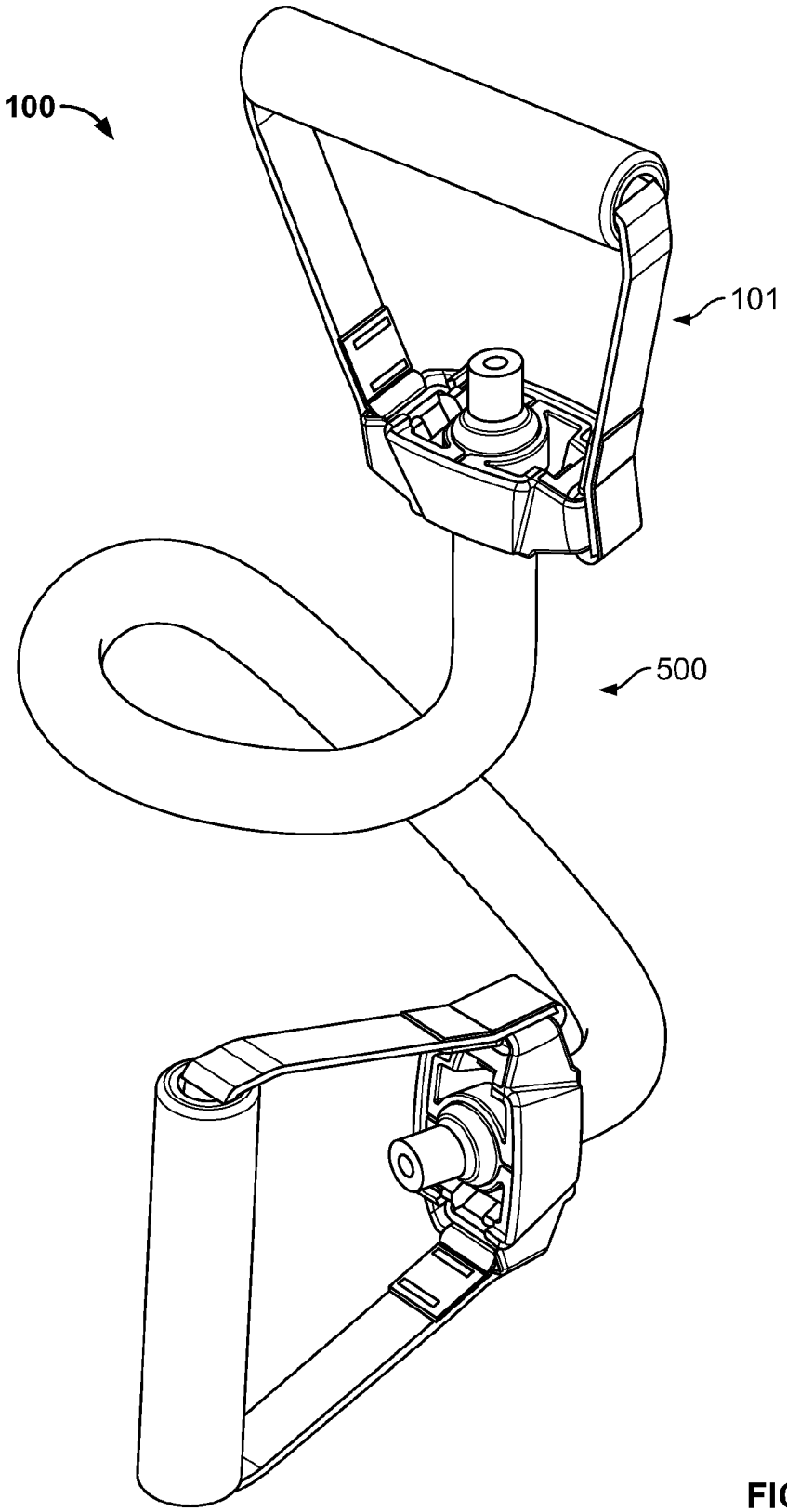
FIG. 1 is a perspective view of an exemplary exercise system including an exemplary handle and accessory.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

The handle of the disclosure provides a system for exercising with linear components, such as resistance tubing, while providing efficient interchangeability options. Such linear accessories may be interchangeable so that only one set of handles is required. The user can change between different sizes and weights of resistance tubing to perform multiple exercises.

The handle of the disclosure securely holds linear components. During use, as axial force increases on the linear component, the linear component is drawn tighter within the handles, to provide for a safe exercise system.

FIG. 1 is a perspective view of an exemplary exercise system 100, including two handle assemblies 101 and one accessory 500, such as a resistance band, the opposed ends of which are secured between handle assemblies 101.

Figure 2:
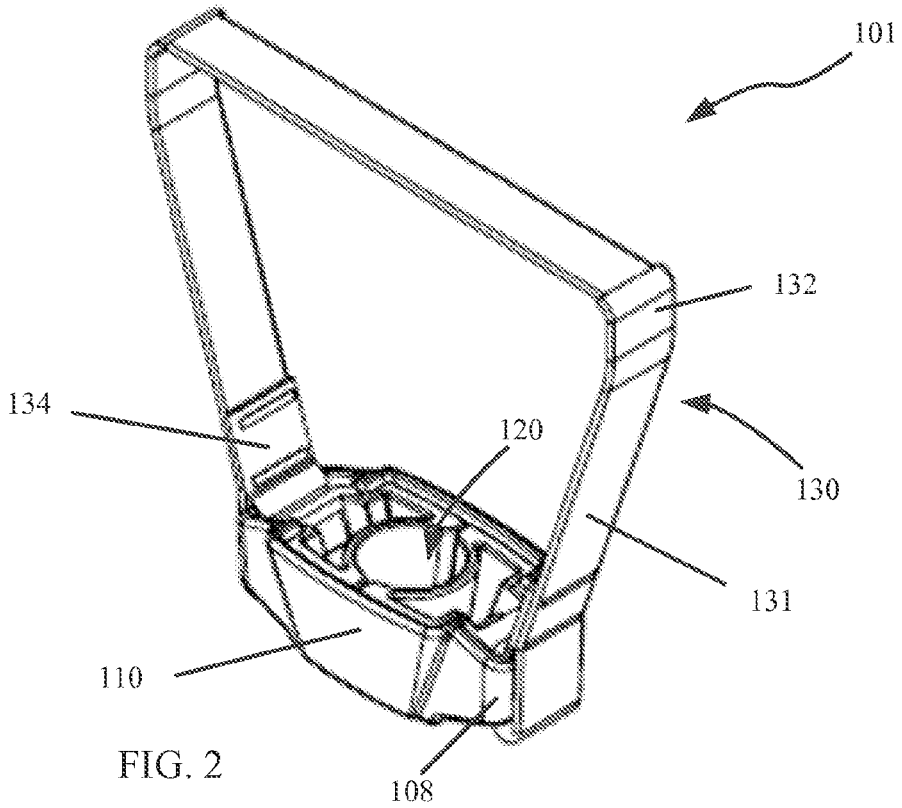
FIG. 2 is a perspective view of an exemplary handle assembly having one accessory holder.

FIG. 2 is an exemplary handle assembly 101, having a casing or housing 110 and a handgrip portion 130 attached to housing 110. Housing 110 is shown as generally rectangular, but may be an alternate shape. Handgrip portion 130 may be a length of nylon strap or webbing 131 looped around an opposed pair of eyelets 108 extending from opposed lateral sides of housing 110, where each end is looped through the eyelet 108 sewn to itself with stitches 134 and/or bonded with adhesives.

Figure 3:
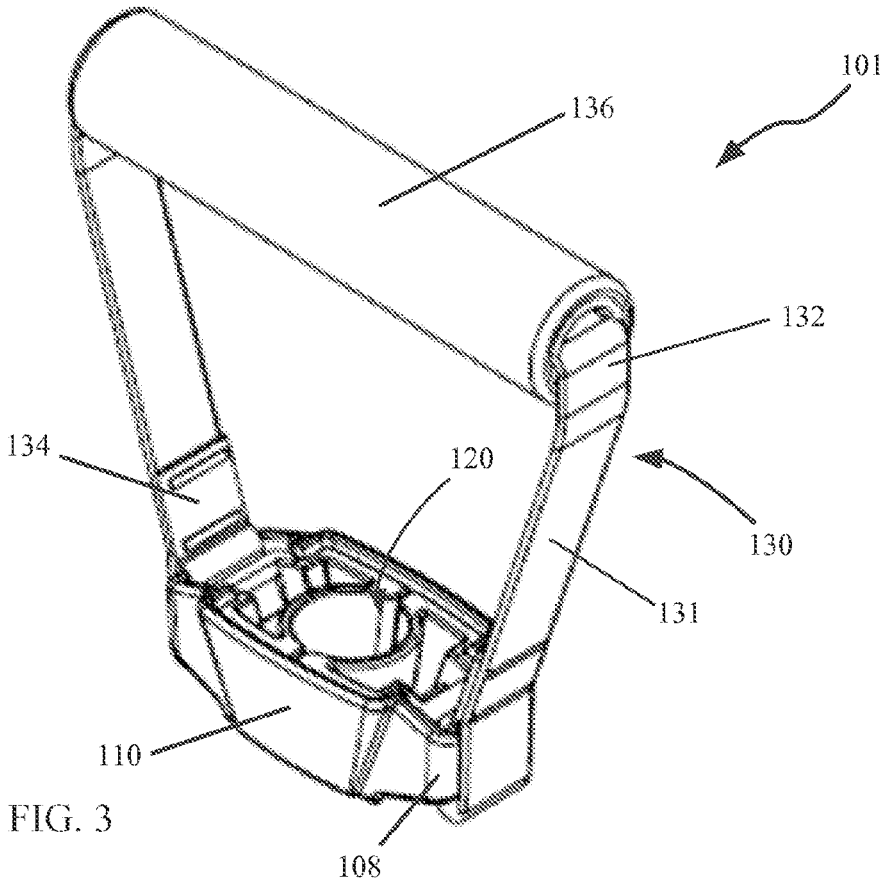
FIG. 3 is a perspective view of the exemplary handle assembly of FIG. 2 including an exemplary handgrip.

As shown in FIG. 3, the nylon webbing 131 may be threaded through a cushioned, tubular handgrip 136 and reinforcements 132 may be provided around the nylon webbing to protect the nylon webbing 131 from edge wear from the tubular handgrip 136. Handgrip 136 may be plastic, and may be encased in foam or rubber.

Figure 4:
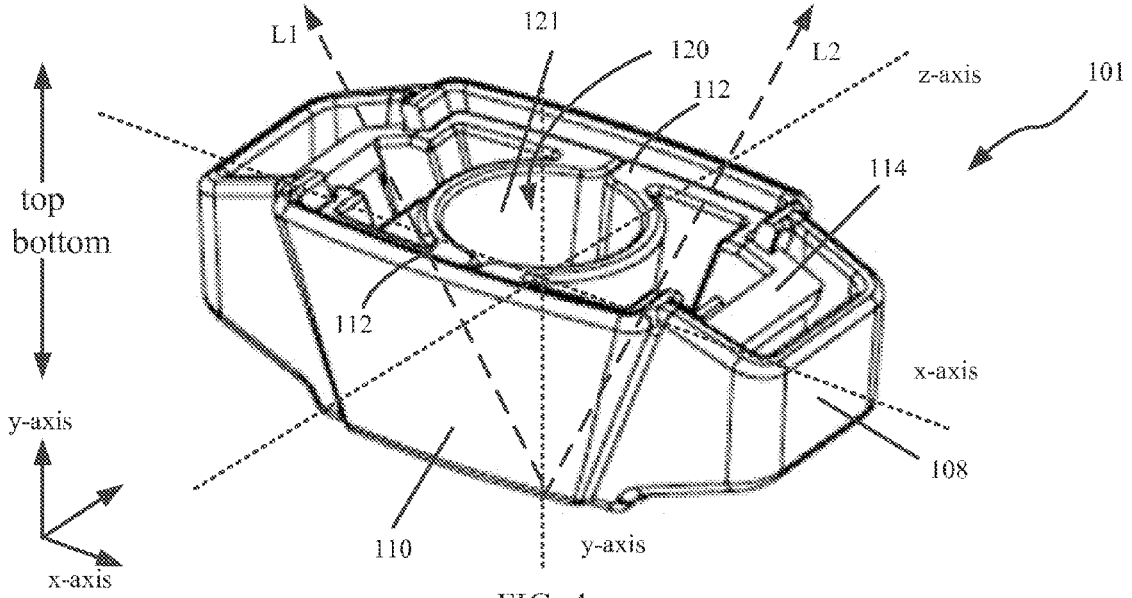
FIG. 4 is a perspective view of the housing portion of the handle assembly of FIG. 2.
Figure 5:
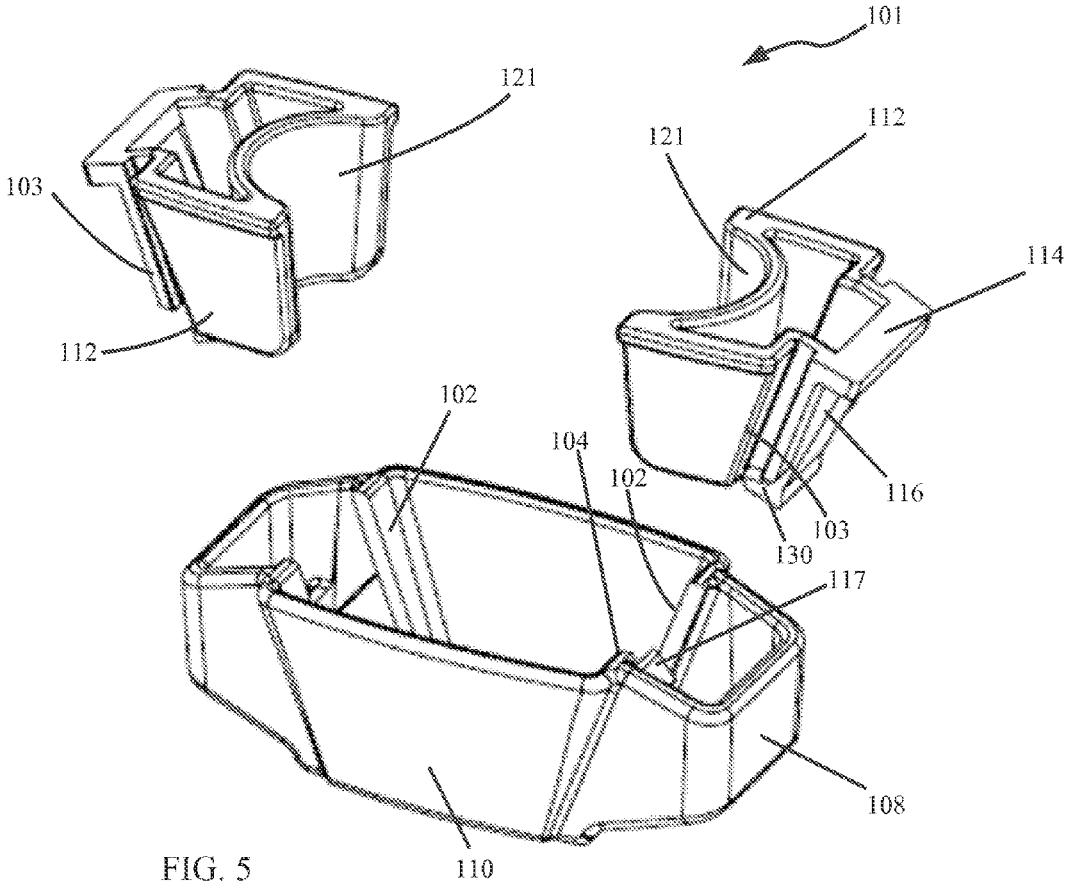
FIG. 5 is an exploded view of the housing portion of the handle assembly of FIG. 2.

As shown in FIGS. 4 and 5, housing 110 includes a pair of accessory capturing blocks that may be in the form of wedges 112 nested adjacently in housing 110. Housing 110 is generally open at the grip end (top as shown in FIGS. 4 and 5) and accessory end (the bottom as shown in FIGS. 4 and 5), and extends slightly beyond each side of wedges 112 to form the eyelets 108 for attaching nylon webbing 131. For the purpose of discussion, a y-axis extends from the accessory end to the grip end and generally axially with respect to the accessory, the x axis extends laterally across the housing 110 from eyelet 108 to eyelet 108, and the z-axis extends in the opposed lateral sides of the housing 110 perpendicular to the sides carrying the eyelets 108. The wedges 112 are generally movable along the x and y axes along a respective pair of slanted lines, L1 and L2, originating at the y-axis (below the x-axis) and angled outwardly in opposite x-directions and in the positive y-direction.

The slanted lines of movement L1, L2 for the wedges 112 may be provided by corresponding slanted outer surfaces 103 of wedges 112 that slide along correspondingly slanted tracks or ramp surfaces 102 of housing 110. Each wedge includes a semi-conical shaped surface 121 opposing the slanted outer surface 103, and the wedges 112 are oriented in the housing 110 such that the semi-conical shaped surfaces 121 face each other. The slanted outer surfaces 103 of the wedges 112 in cooperation of the correspondingly slanted ramp surfaces 102 of the housing allow the wedges 112 to slide within the housing to at least a pair of positions.

In a first position illustrated in FIG. 4, which is an accessory securing position (or closed position), wedges 112 meet approximate the z-axis so that the opposed semi-conical shaped surface 121 of the wedges meet to jointly create a funnel-shaped channel 120 for receiving an accessory, the funnel-shaped channel also herein referred to as accessory holder 120. Wedges 112 may be locked to housing 110 in the first position by a mechanical engagement of biased flanges 130 and extending from tabs 114 against a bottom surface (not shown) of ramp 102 within the housing. Manual manipulation of tabs 114 may overcome the bias to release the flanges 130 from the bottom surface of the ramp 102 to that the wedges may be lifted to the second (or open) position as will be discussed below. As will be apparent to those of ordinary skill, wedges 112 may be releasably locked to housing 110 by any suitable locking means, including locking tabs, latches, spring-loaded balls or pins. Housing 110 and wedges 112 may be molded from plastic.

When unlocked, wedges 112 slide bi-directionally along ramp 102 in a generally up-and-down direction along lines L1 and L2 such that the distance between wedges 112 increases as the wedges slide up towards the grip end of housing 110, providing for the lateral separation of wedges 112. In alternate embodiments, wedges 112 may slide bi-directionally in generally lateral direction, or generally back-and-forth direction. In the current embodiment, a stopper 117 may contact flange 130 as it is sliding up the back side of ramp 102 to prevent wedges 112 from sliding completely out of housing 110.

Figure 6:
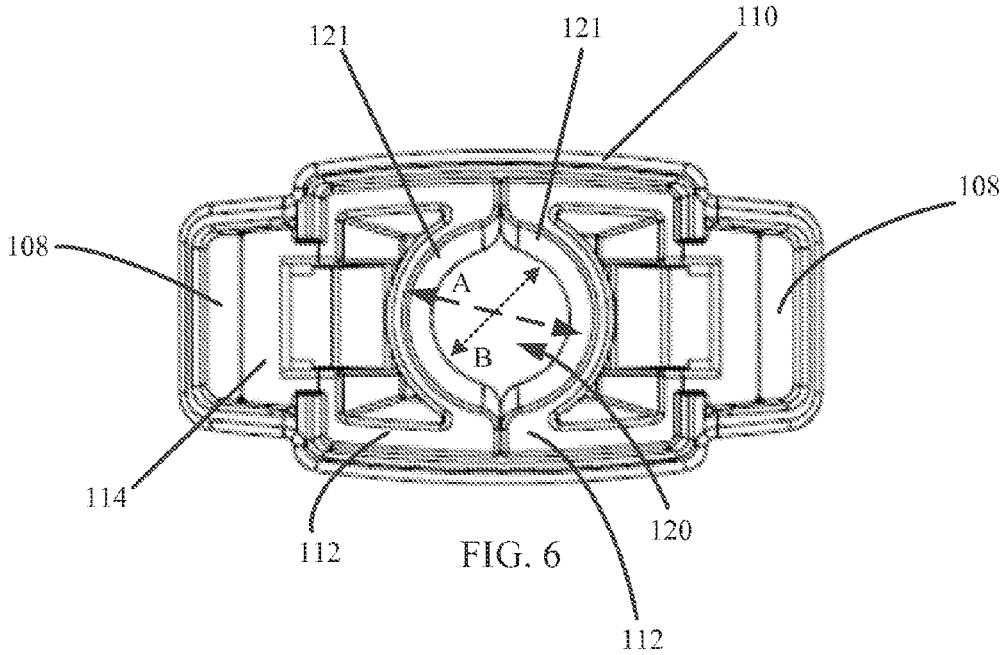
FIG. 6 is a view from the top of the grip end of the assembly of FIG. 4.

As discussed above, the opposed semi-conical shaped surfaces 121 of the wedges meet in the first accessory securing position to form a funnel-shaped channel 120, which has a diameter that decreases from the grip end of the housing to the accessory end of the housing. FIG. 6 is a view from the grip end of the housing 110, and shows an example relative diameter A of the funnel-shaped channel 120 approximate the grip end of the housing and diameter B of the funnel-shaped channel 120 approximate the accessory end of the funnel-shaped channel 120.

Figure 7:
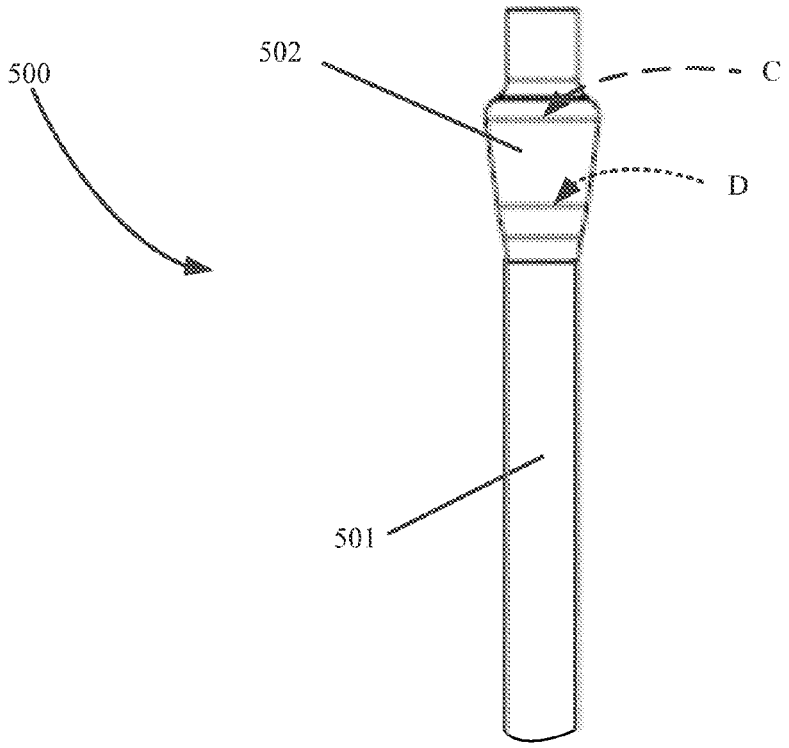
FIG. 7 shows an exemplary accessory.

FIG. 7 illustrates one end of an exemplary accessory 500 including a linear portion 501, such as a resistance tube, having a fixed, conical shaped collar 502 the end. Fixed collar 502 may be made from a rigid or semi-rigid material and have an outer diameter C that is the major diameter and an inner diameter D that is the minor diameter of the conical shape. In an embodiment, the major and minor diameters C and D of the conical collar respectively correspond to diameters A and B of the funnel-shaped channel 120 (see FIG. 6). Linear portion 501 may include cord, elastic exercise cables, bands, webbing, rods, tubes, or any other linear shape part. The opposed end of the accessory not shown in FIG. 7 will have a matching fixed collar 502.

Figure 8:
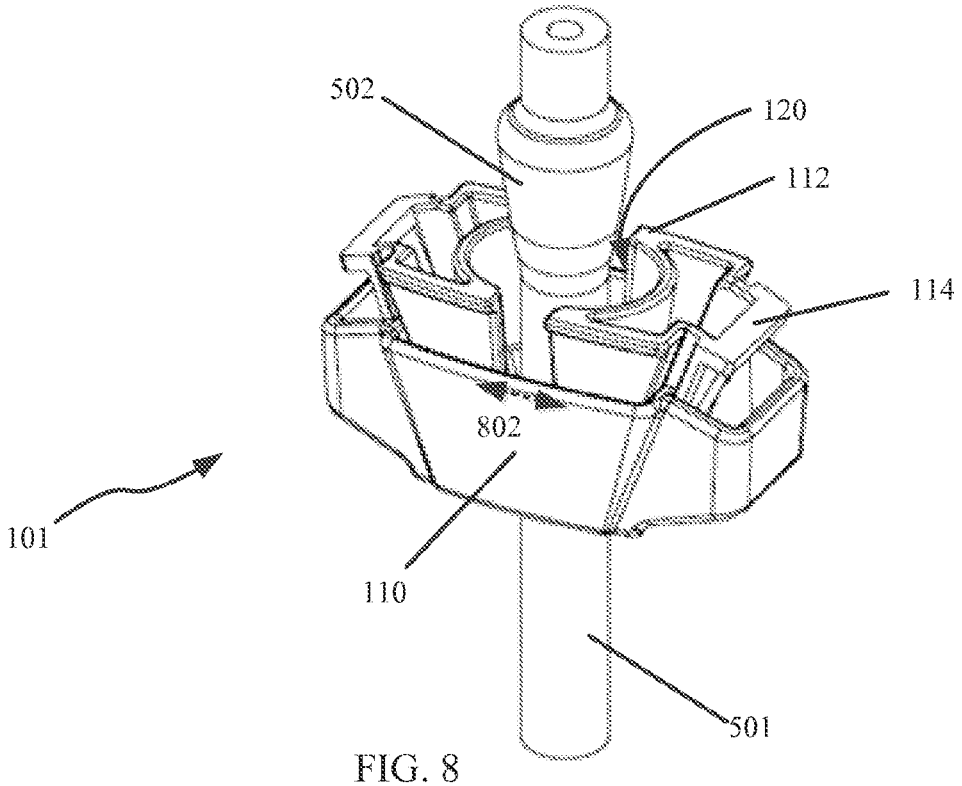
FIG. 8 shows the housing portion of FIG. 4 with the accessory of FIG. 7, where the housing is in an open position.
Figure 9:
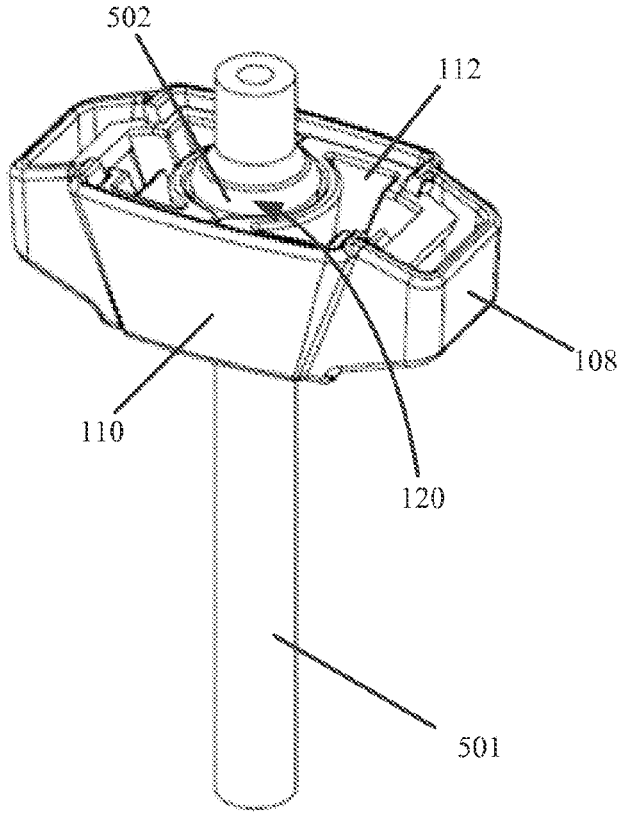
FIG. 9 shows the housing portion of FIG. 4 with the accessory of FIG. 7, where the housing is in a closed position.

FIG. 8 and FIG. 9 shows the process of attaching accessory 500 to handle 101. By unlocking wedges 112 from housing 110 as described above, wedges 112 may slide along ramps 102 of housing 110 as described above, to a second, open position shown in FIG. 8, providing a gap 802 between wedges 112. In the second, open position the minor diameter of the funnel shaped channel 120 formed by the opposed semi-conical shaped surfaces 121 is now larger than the major diameter C of the accessory collar 502, so that the accessory collar may pass freely through the channel 120 and may be removed from or inserted into the handle 101.

Wedges 112 may be moved back to the first position within housing 110, to close gap 802 and capture collar 502 within accessory holder 120, as shown in FIG. 9. While diameters C and D corresponds to diameters A and B, major diameter C of collar 502 is generally larger than minor diameter B of the funnel shaped channel 120 in the first, closed position, to prevent accessory 500 from pulling through handle 101 in this position. When exercise system 100 is in use, the force is applied to accessory 500 is such that diameter C is forced towards the smaller diameter B, wedging conical shaped collar 502 tightly within the funnel shaped channel 120 of the handle 101. Using this concept, a tug may be given to accessory 500 to secure it within handle 101.

Figure 10:
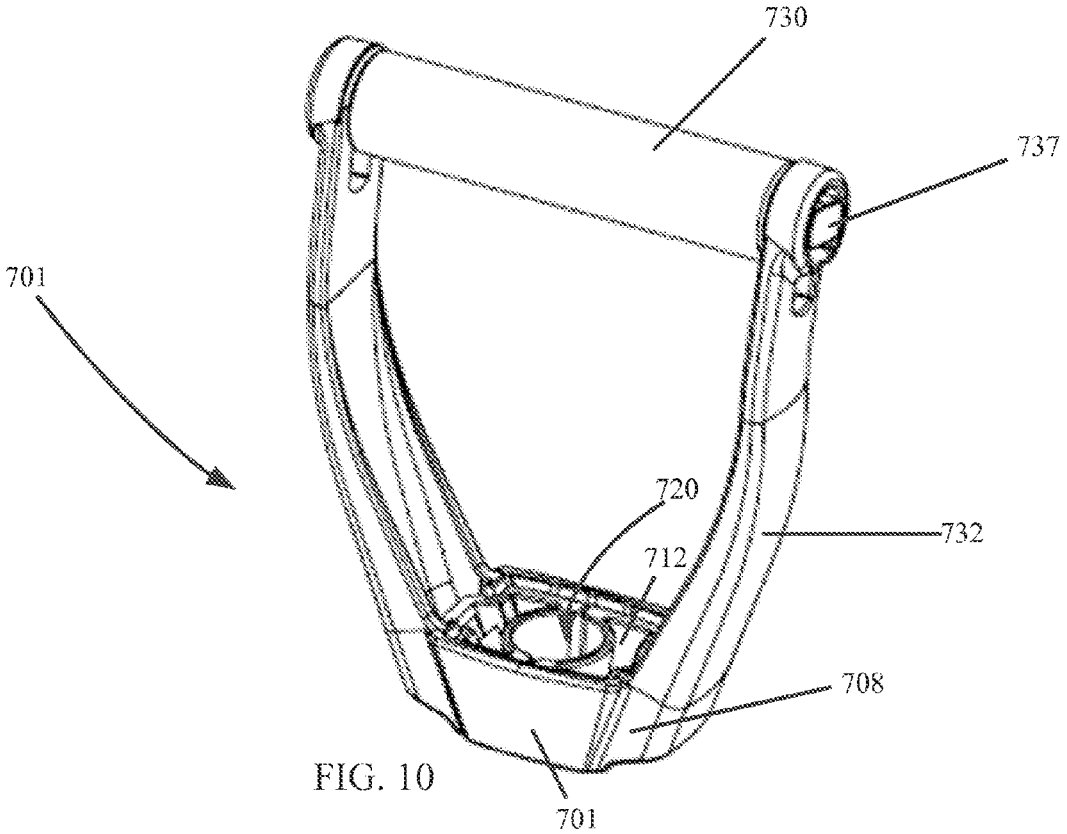
FIG. 10 is a perspective view of a handle having an alternate exemplary handgrip assembly.

FIG. 10 shows an alternate handle 701 assembly with side rails 732 attached to sides 708 of housing 710, and extending beyond the top of housing 710. A rod 737 may bridge side rails 732, and thread handgrip 730 may be carried on the rod. Side rails 732 may be plastic, the rigidity maintaining a stable distance between handgrip 730 and housing 710. Rod 737 may be rectangular to prevent rotation of handgrip 736.

Figure 11:
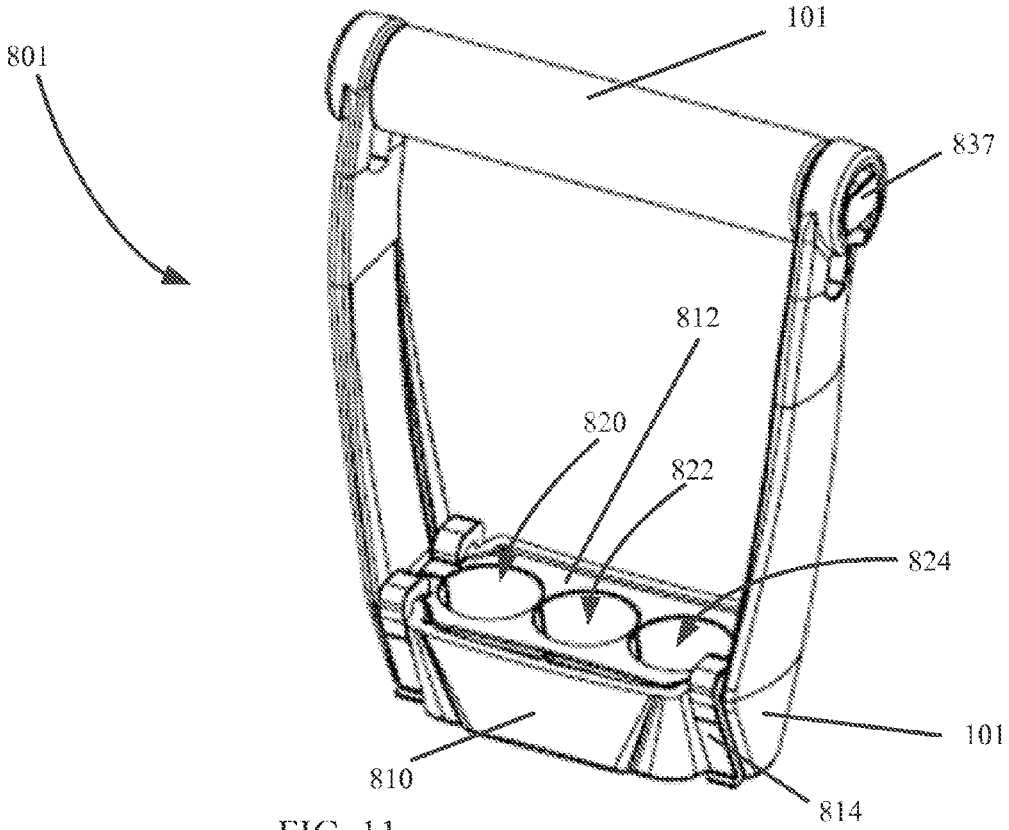
FIG. 11 is a perspective view of an alternate exemplary handle assembly having three accessory holders.
Figure 12:
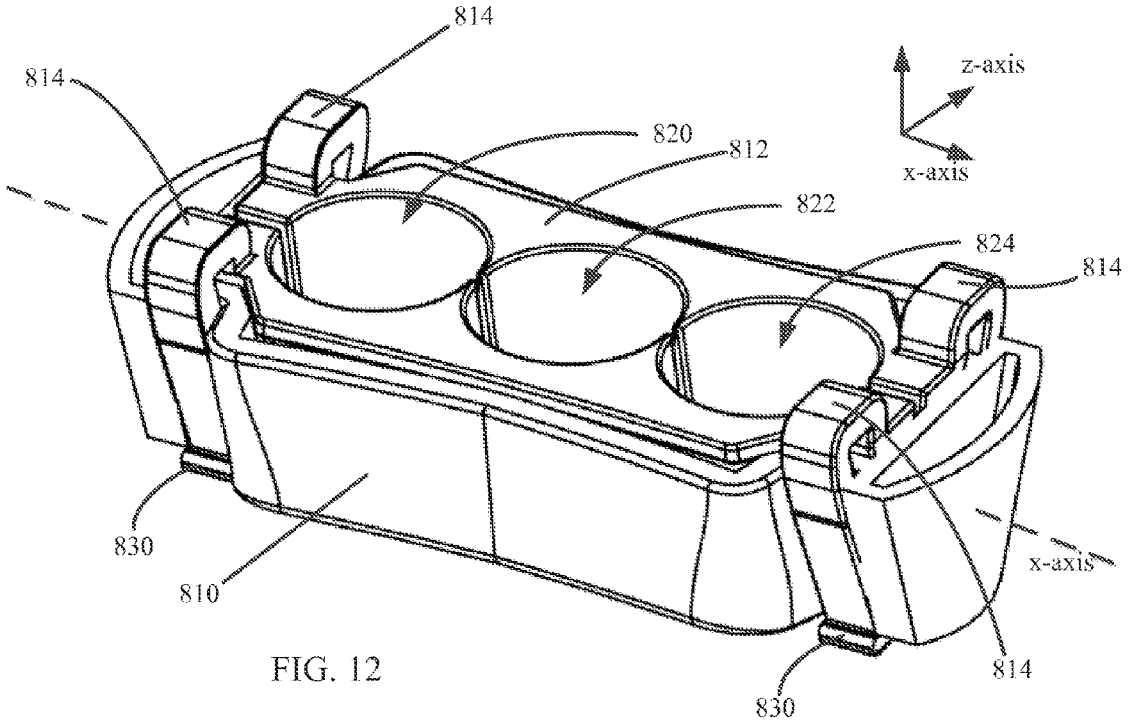
FIG. 12 is a perspective view of the housing of FIG. 11.

In an alternate embodiment, the system of the disclosure may simultaneously accommodate more than one accessory. As shown in FIG. 11 and FIG. 12, handle 801 includes three accessory holders 820, 822, and 824. In other embodiments a different number of accessory holders may be used, such as two or four accessory holders. In this embodiment, wedges 812 meet along the x-axis as shown in the axis diagram by FIG. 12 so that both wedges 812 include at least a portion of each accessory slot 820, 822, and 824. This configuration minimizes the number of parts and complexity, maximizing integrity and strength of the handle 701. Accessory slots 820, 822, 824 may be the same size for universal interchangeability. Accessory 500 collars 502 may be the same size, and linear components 501 may be varying material, elasticity, or length. In other embodiments, accessory holders 820, 822, and 824 may be different sizes.

Figure 13:
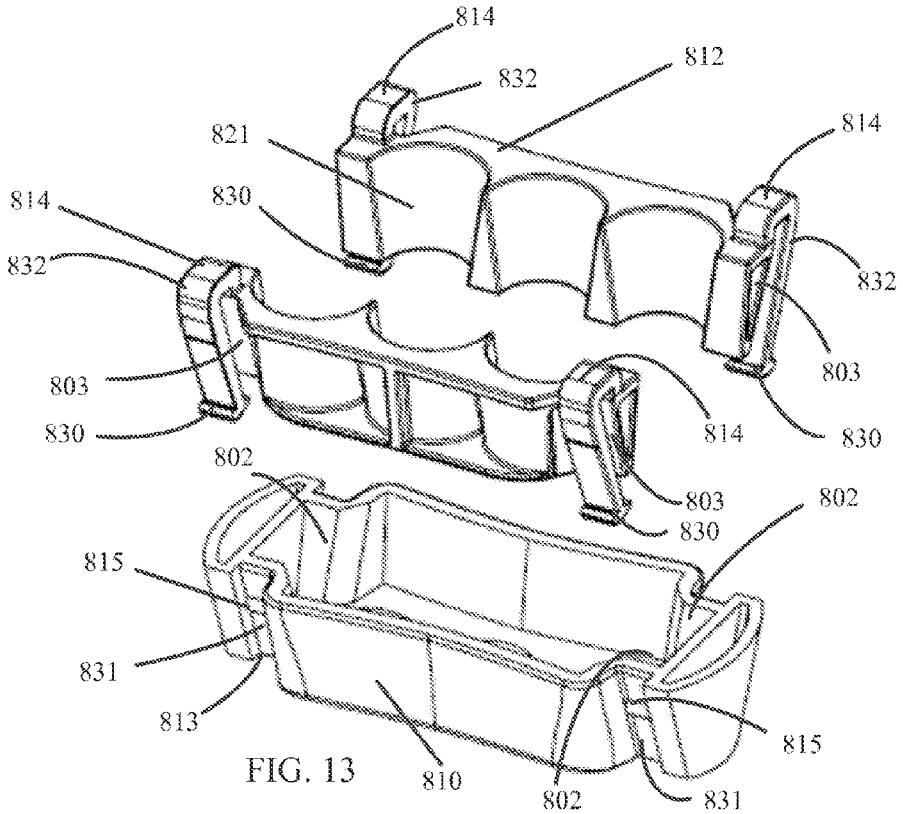
FIG. 13 is an exploded view of the housing of FIG. 11.

FIG. 13 is an exploded view of housing 810 and wedges 812. Accessory holders 820, 822, 824 maintain the conical taper as discussed above. Four latches 814 lock wedges 812 to housing 810 at the bottom surface 813 of housing 812, where each wedge 812 has two latches 814, one on each end. Each latch 814 includes a flange 830 biased inwardly (towards the housing by spring arm 832) to slide in a corresponding groove 831 provided on the outer surface of the housing 810. When the flange 830 passes below the bottom surface (when the wedge 812 is in the first, closed, position) of the housing 810 the inward bias causes the flange 830 to secure onto the bottom surface 813. To unlock the wedge from the first position, the flange 830 may be pulled away from the bottom surface 813, overcoming the bias. As described in the embodiment above, wedges 812 have a first closed and a second open position. Protuberance 815 is provided in the groove 821 to act as a stop to limit movement of the flange 831 from passing above the protuberance. Consequently, when the wedge 812 is lifted until the protuberance stops further upward movement of the wedge 812, the wedge 812 is in its second open position.

While various aspects and embodiments have been disclosed herein, other aspects and embodiments will be apparent to those skilled in the art. For example, it is within the scope of the disclosure that only one of the wedges are moveable to create the widening/narrowing diameter of the funnel shaped channel. Additionally, it is within the scope of the disclosure that the accessory holders can have alternate shapes other than the funnel/conical shapes disclosed and illustrated herein. For example, the holders can be semi-spherical in shape (and the accessory collars may have a corresponding semi-spherical shape). It is also within the scope of the disclosure that other shapes for the holders and collars may be used, so long as the holder channel has an adjustable minor diameter (or minimum width—the channel need not be circular) that is sized to lock the collar of the accessory in place in a closed position, and adjustable to a larger diameter (or larger width) than the major diameter of the collar (or major width of the collar) to allow the collar pass by the holder in an open position.

The various aspects and embodiments disclosed herein are for purposes of illustration and are not intended to be limiting, with the true scope and spirit being indicated by the following claims.

What is claimed is:

1. An exercise system, comprising:

at least one handle having a housing having a grip end and an opposed accessory end, the accessory end having an opening along an accessory axis, a grip extending from the grip end, and at least one locking block provided in the housing and slidable along an angled track within the housing between at least a first position proximate the accessory axis and a second position away from the accessory axis, the first position providing a narrow width accessory opening and the second width providing a wider accessory opening; and an accessory having at least one end with a protrusion proximate thereto sized to be captured within the accessory opening when the locking block is in the first position and sized to be passable through the accessory opening when the locking block is in the second position.

2. The exercise system of claim 1 further comprising a pair of locking blocks slidable along opposed angled tracks within the housing towards and away from the accessory axis.

3. The exercise system of claim 2 wherein the locking blocks include a semi-conical surface facing the accessory axis, the semi-conical surface forming a funnel-shaped channel along the accessory axis when the locking blocks are in the first position.

4. The exercise system of claim 3 wherein said protrusion provided on the accessory is conical in shape.

5. The exercise system of claim 1 wherein the locking block is releasably lockable in the first position.

6. The exercise system of claim 1 wherein the tracks include a stop preventing the locking block from moving out beyond the second position.

7. The exercise system of claim 1 wherein the accessory is a resistance band.

8. An exercise system, comprising:

at least a pair of handles, each handle comprising:

a housing having a gripping end and an accessory end, the accessory end having an opening with an accessory axis, at least a pair of wedges provided in the housing and movable between a first and a second position within the housing, wherein in the first position the pair of wedges are nested within the housing adjacent to each other to jointly form a channel along the accessory axis, the channel having a major diameter proximate the gripping end of the housing and a minor diameter proximate the accessory end of the housing;

a grip attached to the housing; and an accessory having two ends, each end having a collar respectively securable to one of the two handles and sized to be captured within the channel when the pair of wedges are in the first position.

9. The exercise apparatus of claim 8 wherein each of the pair of wedges comprise a semi conical surface to form a respective portion of the channel.

10. The exercise apparatus of claim 8 wherein in the second position the pair of wedges are partially un-nested from the housing and are separated by a gap sized to allow the collar of the accessory end to freely passes in the gap between the pair of wedges.

11. The exercise apparatus of claim 8 wherein the wedges slide along slanted tracks in the housing between the first position and the second position.

12. The exercise apparatus of claim 8 further comprising a locking mechanism to releasably secure the wedges in the housing when the wedges are in the first position.

13. The exercise apparatus of claim 12 wherein the locking mechanism comprises at least one of a biased tang, a tab, a pin, and a spring loaded ball.

14. The exercise apparatus of claim 8 wherein the pair of wedges jointly form a plurality of channels for capturing a collar of a respective plurality of accessories therebetween.

15. An exercise apparatus comprising:

a handle comprising a gripping portion and an accessory holding portion, wherein the accessory holding portion comprises a housing and at least one locking block movable between a first position to provide an accessory opening in the housing of a first area to a second position to provide an accessory opening in the housing of a second area, the first area being smaller than the second area;

an accessory having an end and having a collar located proximate said end, said collar having an end defining an area larger than the first area and smaller than the second area such that the collar may be threaded through the accessory opening when the locking block is in the second position and be captured by the locking block when the locking block is in the first position.

16. The exercise apparatus of claim 15 further comprising a lock for locking the locking block in the first position.

17. The exercise apparatus of claim 15 further wherein at least two locking blocks are provided movable towards and away from each other between the first position the second position.

18. The exercise apparatus of claim 15 wherein the locking block is movable along an angled track in the housing.

19. The exercise apparatus of claim 15 wherein the collar is conical in shape.

20. The exercise apparatus of claim 15 wherein the accessory opening is circular in shape when the locking block is in the first position.

* * * * *